US006340922B1

(12) United States Patent
Rust

(10) Patent No.: US 6,340,922 B1
(45) Date of Patent: Jan. 22, 2002

(54) WAVEGUIDE FILTER WITH THREE APERTURES FOR PASSING TRANSMISSION FREQUENCIES AND BLOCKING INTERFERENCE FREQUENCIES

(75) Inventor: Stefan Rust, Senden (DE)

(73) Assignee: DaimlerChrysler Aerospace AG, Munich (DE)

( * ) Notice: Subject to any disclaimer, the term of this patent is extended or adjusted under 35 U.S.C. 154(b) by 0 days.

(21) Appl. No.: 08/981,789

(22) PCT Filed: Jun. 20, 1996

(86) PCT No.: PCT/EP96/02686

§ 371 Date: Dec. 30, 1997

§ 102(e) Date: Dec. 30, 1997

(87) PCT Pub. No.: WO97/02619

PCT Pub. Date: Jan. 23, 1997

(30) Foreign Application Priority Data

Jun. 30, 1995 (DE) ..... 195 23 869

(51) Int. Cl.[7] ..... H01P 1/207
(52) U.S. Cl. ..... 333/208; 333/212
(58) Field of Search ..... 333/208, 210, 333/212, 230, 135

(56) References Cited

U.S. PATENT DOCUMENTS 4,135,133 A * 1/1979 Mok ..... 333/212 X
4,211,987 A * 7/1980 Pan ..... 333/230
4,652,844 A * 3/1987 Brambilla ..... 333/212
4,800,349 A * 1/1989 Gurcan et al. ..... 333/208

FOREIGN PATENT DOCUMENTS

EP 0029276 5/1981
GB 1104184 2/1968

OTHER PUBLICATIONS

Atia et al., "New Types of Waveguide Bandpass Filters for Satellite Transponders," COMSAT Tech. Rev., vol. 1, No. 1, Sep. 1971.*

* cited by examiner

*Primary Examiner*—Justin P. Bettendorf
(74) *Attorney, Agent, or Firm*—Venable; George H. Spencer; Norman N. Kunitz

(57) ABSTRACT

A band-pass filter for a waveguide, which additionally serves as a blocking filter for the concerted suppression of interference frequencies. In addition to a centrally arranged aperture (3), a waveguide aperture has two identically designed apertures (4), which are laid out for natural resonance for an interference frequency f (ind S1) to be blocked by the waveguide filter, and are arranged symmetrical to the central aperture opening (3). In waveguide devices, the invention is used to meet the statutory frequency specifications and simultaneously suppress interference frequencies.

16 Claims, 2 Drawing Sheets

WAVEGUIDE FILTER WITH THREE APERTURES FOR PASSING TRANSMISSION FREQUENCIES AND BLOCKING INTERFERENCE FREQUENCIES

BACKGROUND OF THE INVENTION

The invention concerns a waveguide filter of the type that is inserted as a planar conducting structure in a cross-sectional plane of an elongated waveguide, perpendicular to the waveguide axis, between a feeding and an extending segment of the waveguide, and comprising at least one aperture configured for natural resonance for a selected transmission frequency.

Meeting the statutory regulations for the frequency band specifications, particularly with respect to the suppression of oscillator-generated interference radiation, e.g., a harmonic of the useful signal, represents a considerable share of the development costs for an equipment concept. At present, the use of waveguide resonators coupled to waveguide apertures as well as the use of resonance structures for FIN line circuits in the region of the fin-lines are known for waveguide circuits.

The layout of waveguide apertures is based on the known theories in waveguide aperture technology (Waveguide Handbook, N. Marcuwitz, Mc Graw-Hill Book Company, INC., Edition 1986). The waveguide apertures are formed as planar structures, for example with circular, slotted or H-shaped apertures and are inserted into a cross-sectional plane of an elongated waveguide, perpendicular to the waveguide axis, between a feeding and an extending segment of the waveguide. When used as band-pass filters, the apertures are operated with natural resonance, which for slotted apertures is set to an electrically effective slot length of one half the wavelength for the useful frequency, as is known. The transmission factor T of slotted apertures is determined by the slot width. Outside of their pass range, the waveguide apertures designed as band-pass filters have an attenuation course that corresponds only to the resonance curve. In particular, no concerted blocking of specific interference frequency multiples of the useful frequency is generally possible with these band-pass filters. For this, the known band-pass filters must be supported by additional filtering measures. In many cases, e.g. with small devices or with sensors, the volume required for the known band-pass filters causes interferece. The production costs for FIN conductors with resonance structures are relatively high.

A waveguide filter is furthermore disclosed in the EP 0 029 276 A1, which is composed of four planar conducting structures that cooperate in the waveguide field and which are integrated into the wall of a waveguide that is fed by a transmitter. The conducting structures are integrated across the circumference of the waveguide in a cross-sectional plane into the wall area, displaced by 90° to each other, and respectively feed into an extending waveguide segment. In addition to a central aperture that is laid out for natural resonance for a transmission frequency, each of the conductive structures has two identically configured apertures, designed to suppress interference frequencies. These apertures are arranged on one longitudinal side of the central aperture, so that with respect to their longitudinal expansion, they are not positioned in the center of the symmetry axis for the conducting structure, which runs parallel to the field strength vectors.

It is the object of the invention to create a band-pass filter for waveguides, which simultaneously functions as a blocking filter for the targeted suppression of interference frequencies.

SUMMARY OF THE INVENTION

The above object is solved in accordance with a first aspect of the invention a waveguide filter that is inserted as a planar conducting structure in a cross-sectional plane of an elongated waveguide, perpendicular to the waveguide axis, between a feeding and an extending segment of the waveguide, that comprises a centrally arranged aperture formed for natural resonance for a selected transmission frequency f (ind 0), and that has, in addition to the centrally arranged aperture, two identically configured, parallel, spaced-apart apertures, and wherein: the identically configured apertures are formed for natural resonance for an interference frequency f (ind S1) to be blocked by the waveguide filter, and the apertures are arranged in the conducting structure such that, relative to a longitudinal expansion of the respective apertures, the apertures are positioned respectively in the center of a symmetry axis for the conducting structure, which axis runs parallel to the field strength vectors for the waveguide.

The above object is achieved according to a further aspect of the invention by a waveguide filter, that is inserted as a planar conducting structure in a cross-sectional plane of an elongated waveguide, perpendicular to the waveguide axis, between a feeding and an extending segment of the waveguide, and comprising at least one aperture configured for natural resonance for a selected transmission frequency f (ind 0), and wherein the conducting structure has a centrally arranged aperture configured for natural resonance for an interference frequency f (ind S1) to be blocked with the waveguide filter; and, in addition to the centrally arranged aperture, the conducting structure comprises two identically designed apertures, which are configured for natural resonance for a selected transmission frequency f (ind 0) and are arranged symmetrical to the central aperture. Modifications of the invention are described.

The advantage of this invention is that the transmission of a useful frequency and a targeted suppression of interference frequencies are possible with a single component and at low expenditure. The waveguide filter according to the invention makes it possible to adhere to production tolerances at a low cost and requires only a low installation depth. Owing to its symmetrical arrangement, the excitation of the interference mode is at a minimum.

Exemplary embodiments of the invention are explained in more detail with the aid of the drawing.

DETAILED DESCRIPTION OF THE PREFERRED EMBODIMENTS

Figure 1:
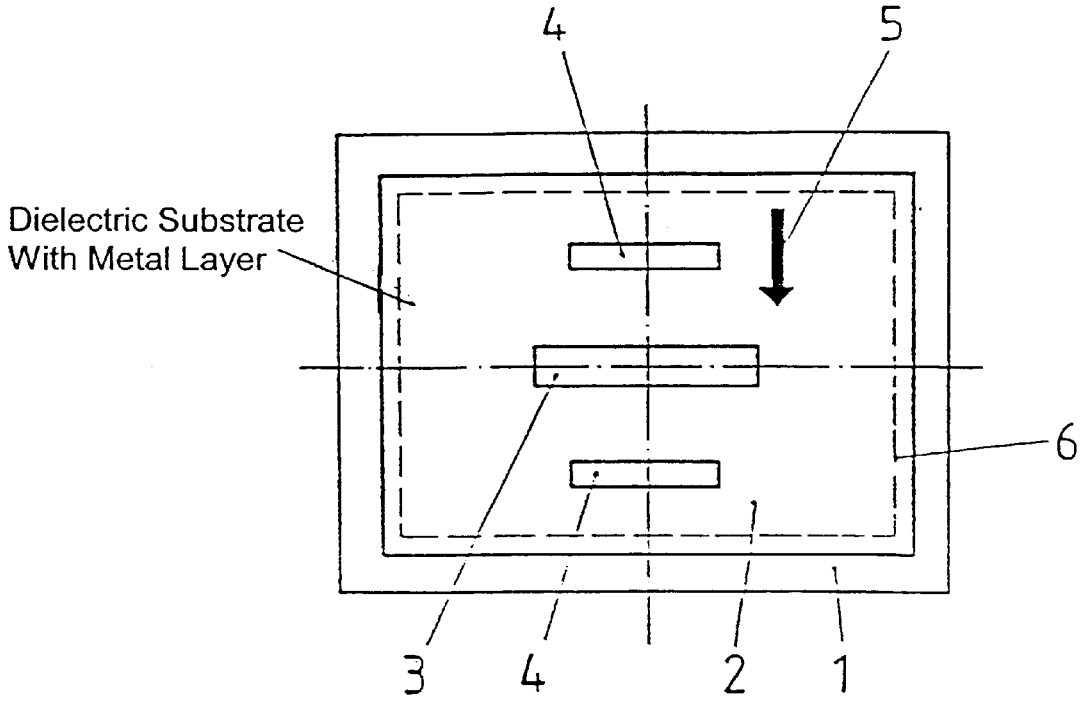
FIG. 1 shows the principle of the conductive structure of a waveguide filter according to the invention for rectangular waveguides.

FIG. 1 shows the conductive structure 2 of a waveguide filter, which is placed onto the cross-sectional surface of a rectangular waveguide 1. The conductive structure 2 is formed in a metal layer of a planar, dielectric substrate that is metallized on one side. A centrally arranged aperture 3 and two additional apertures 4, arranged symmetrically adjacent to the centrally positioned aperture 3, are integrated into the conductive structure 2.

The apertures 3, 4 are designed as slotted guides, short-circuited on both sides, and are arranged parallel to each other and perpendicular to the vectors 5 of the adjoining waveguide-E-field. The electrically effective length of the centrally arranged slotted guide is half a wavelength of the transmission frequency f (ind 0), and the electrically effective length of the associated slotted guide respectively is half a wavelength of an interference or harmonic frequency f (ind S1) to be blocked by the waveguide filter. The slotted guides dimensioned in this way are in natural resonance for the coordinated frequencies and radiate with maximum capacity into the adjoining, extending segment of the waveguide 1. The transmission phases of the centrally arranged slotted guide and those of the coordinated slotted guides have opposite signs in the frequency range f (ind 0)–f (ind S1) and a differing phase slope, so that in the extending segment of waveguide 1, the amount for the sum vector of the superimposing slotted guide fields is minimized. It is known that the transmission factor (and thus also the amplitude of the E-field radiated from the slotted guide) can be influenced by varying the electrically effective slotted guide width. An optimum compensation of the radiated slotted guide fields can be adjusted with this in the extending segment of the waveguide 1 by adapting the individual slot widths relative to each other for the interference frequency f (ind S1) to be blocked.

The effect according to the invention can also be achieved optionally if only one slotted guide 4 is assigned to the centrally arranged slotted guide 3 in the manner as described in the above. However, assigning two slotted guides 4 has the advantage that the excitation of the interference modes is at a minimum owing to the symmetrical structure of the waveguide filter. Arranging the two coordinated slotted guides 4 near the border 6 of the waveguide inside space also contributes to this.

On principal, it is possible to invert the assignment of the transmission frequency and the interference frequency to be blocked with the apertures 3 and 4, so that the centrally arranged aperture 3 is configured for the interference frequency f (ind S1) and the coordinated apertures 4 for the transmission frequency f (ind 0).

In place of the exemplary embodiment with slotted guides, shown in FIG. 1, it is also conceivable to use other cross-sectional shapes having natural resonances for the desired frequencies for the apertures 3 and 4, e.g., H-shaped apertures.

Figure 2A:
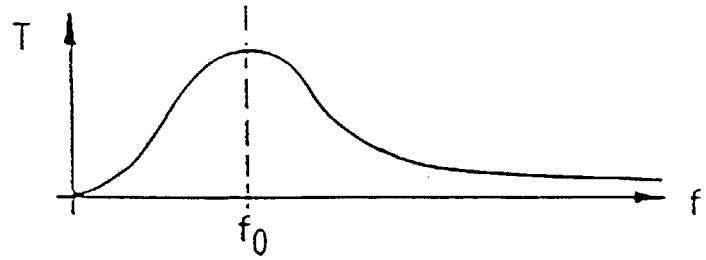
FIGS. 2A to 2C show transmission curves of individual apertures and for the complete waveguide filter.
Figure 2B:
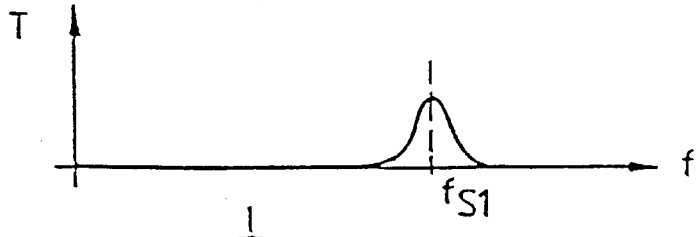
Figure 2C:
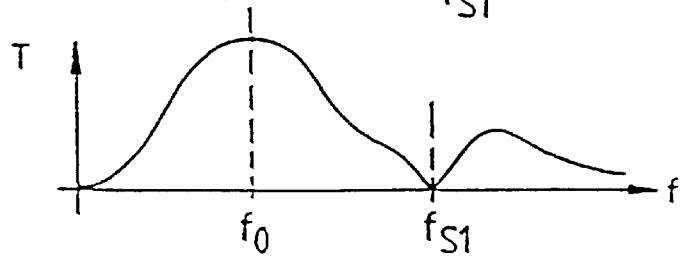

FIGS. 2A to 2C show the transmission curves for the waveguide filter according to FIG. 1. The transmission curve for the centrally arranged slotted guide 3 is shown in FIG. 2A the transmission curve for the cooperating, coordinated slotted guides 4 is shown in FIG. 2B and the transmission curve for all superimposed slotted guide fields of the waveguide filter is shown in FIG. 2C.

Figure 3:
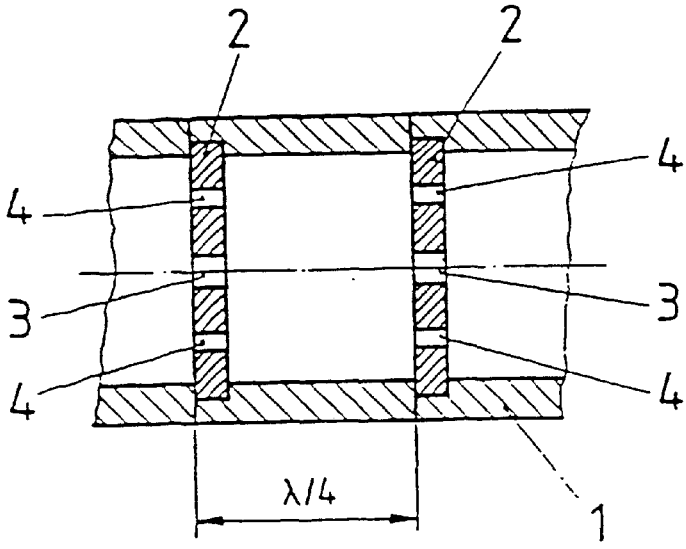
FIG. 3 shows a double-circuit waveguide filter with two successively arranged conductive structures.

A waveguide filter with two circuits for the blocking effect can be realized in accordance with the embodiment shown in FIG. 3 in that two spaced-apart conductor structures 2, for which the design basically corresponds to the embodiment in FIG. 1, are inserted into the waveguide.

The distance between the conducting structures 2 is one fourth the wavelength of the transmission frequency f (ind 0). The natural resonances for the coordinated slotted guides of the one conducting structure 2 are laid out for a first interference frequency f (ind S1) and the natural resonances of the second conducting structure for a second interference frequency f (ind S2). In both conducting structures, the natural resonances of the centrally arranged slotted guides 3 are laid out for the transmission frequency f (ind 0).

Figure 4A:
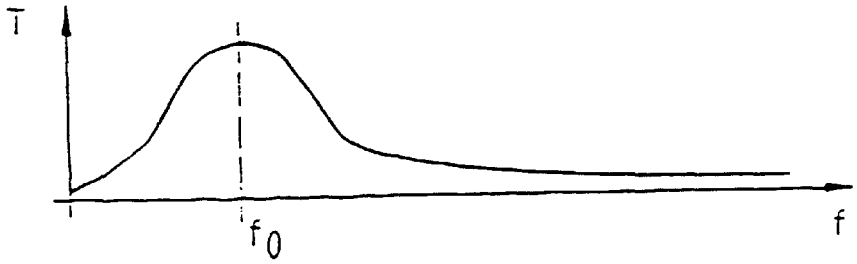
FIGS. 4A to 4D show transmission curves of individual apertures and of the complete double-circuit waveguide filter.
Figure 4B:
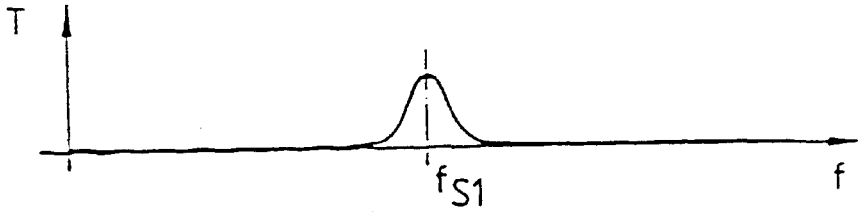
Figure 4C:
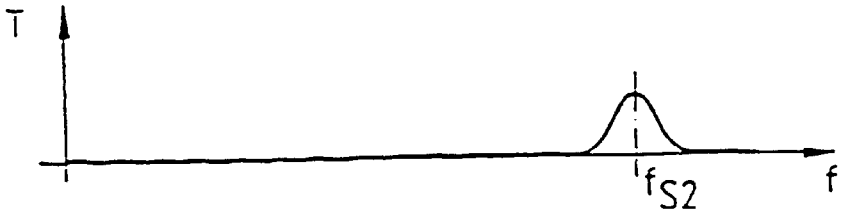
Figure 4D:
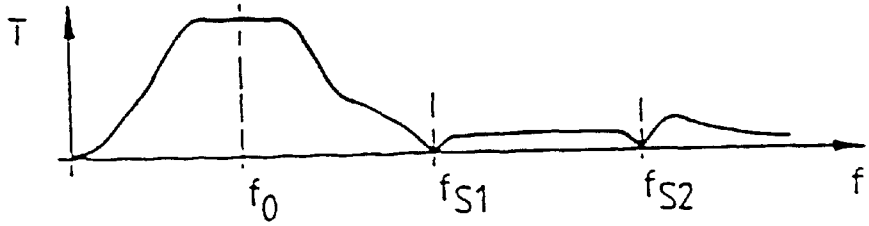

FIGS. 4A to 4D show the transmission curves for the waveguide filter shown in FIG. 3. FIG. 4A shows the transmission curve for one of the centrally arranged slotted guides. The FIGS. 4B and 4C show the transmission curves for the two cooperating, coordinated slotted guides of a conductive structure for the respective interference frequency. FIG. 4D shows the transmission curve for the complete, two-circuit waveguide filter. In addition to the blocking effects for the interference frequencies f (ind S1) and f (ind S2), the curve shows in the transmission range a flattening around the frequency f (ind 0).

The waveguide filter according to the invention can also be configured for waveguides with different cross-sectional shapes, wherein attention must be paid to a perpendicular alignment of the slotted guides relative to the vectors 5 of the adjoining waveguide-E-field.

The conducting structure 2 can be a metal foil with a thickness not to exceed one eighth the wavelength of the highest interference frequency to be blocked. However, it can also be formed in the metal layer of a dielectric substrate that is metallized on one side, wherein the filtering qualities worsen with an increasing value for the dielectric constant of the substrate.

What is claimed is:

1. A waveguide filter inserted as a planar first conducting structure in a cross-sectional plane of an elongated waveguide, perpendicular to the waveguide axis, between a feeding and an extending segment of the waveguide, with the first conducting structure having a centrally arranged aperture formed for natural resonance for a selected transmission frequency f (ind 0), and, in addition to the centrally arranged aperture (3), two identically configured, parallel, spaced-apart apertures (4), and wherein the identically configured apertures (4) are formed for natural resonance for an interference frequency f (ind S1) to be blocked by the waveguide filter, and the apertures (3,4) are arranged in the conducting structure (2) such that, relative to a longitudinal expansion of the respective apertures, the apertures are positioned respectively in the center of a symmetry axis for the conducting structure (2), which axis runs parallel to field strength vectors (5) for the waveguide.

2. A waveguide filter according to claim 1, wherein the waveguide (1) has a circular cross section.

3. A waveguide filter according to claim 1, wherein the centrally arranged aperture (3) and the additional apertures (4) are designed as slotted guides, the slotted guides are aligned perpendicular to the vectors (5) of the adjoining waveguide-E-field, and the electrically effective length of the slotted guides is one half the wavelength of the transmission frequency f (ind 0) or the interference frequency f (ind S1), depending on the respective natural resonance frequency.

4. A waveguide filter according to claim 3, wherein the slotted guide widths are tuned to the desired transmission and blocking effect.

5. A waveguide filter according to claim 1, wherein a second conducting structure (2) is inserted in a cross-sectional plane of the waveguide, at a distance to the first conducting structure (2), with said distance corresponding approximately to one fourth the wavelength of the selected transmission frequency f (ind 0), and the second conducting structure (2) comprises a central aperture (3) with a natural resonance at the selected transmission frequency f (ind 0)

and two additional apertures (4), respectively with a natural resonance at a second interference frequency f (ind 2) to be blocked, which differs from the interference frequency f (ind S1) of the apertures of the first conducting structure.

6. A waveguide filter according to claim 1, wherein the conducting structure (2) is a metal foil with the apertures (3,4) formed therein.

7. A waveguide filter according to claim 1, wherein the conducting structure (2) is composed of a dielectric substrate that is metallized on one side, and the apertures (3,4) are formed in the metal layer of the substrate.

8. A waveguide filter according to claim 1, wherein the waveguide (1) has a rectangular cross section.

9. A waveguide filter, inserted as a first planar conducting structure in a cross-sectional plane of an elongated waveguide, perpendicular to the waveguide axis, between a feeding and an extending segment of the waveguide, with the first planar conducting structure comprising at least one aperture configured for natural resonance for a selected transmission frequency f (ind 0), and wherein the conducting structure (2) has a centrally arranged aperture (3), configured for natural resonance for an interference frequency f (ind S1) to be blocked with the waveguide filter; and, in addition to the centrally arranged aperture (3), the at least one aperture of the first planar conducting structure (2) comprises two identically designed apertures (4), which are configured for natural resonance for a selected transmission frequency f (ind 0) and are arranged symmetrical to the central aperture (3).

10. A waveguide filter according to claim 9, wherein the centrally arranged aperture (3) and the additional apertures (4) are designed as slotted guides, the slotted guides are aligned perpendicular to the vectors (5) of the adjoining waveguide-E-field, and the electrically effective length of the slotted guides is one half the wavelength of the transmission frequency f (ind 0) or the interference frequency f (ind S1), depending on the respective natural resonance frequency.

11. A waveguide filter according to claim 10, wherein the slotted guide widths are tuned to the desired transmission and blocking effect.

12. A waveguide filter according to claim 9, wherein a second conducting structure (2) is inserted in a cross-sectional plane of the waveguide, at a distance to the first conducting structure (2), with said distance corresponding approximately to one fourth the wavelength of the selected transmission frequency f (ind 0), and the second conducting structure (2) comprises a central aperture (3) with a natural resonance at the selected transmission frequency f (ind 0) and two additional apertures (4), respectively with a natural resonance at a second interference frequency f (ind 2) to be blocked, which differs from the interference frequency f (ind S1) of the apertures of the first conducting structure.

13. A waveguide filter according to claim 9, wherein the conducting structure (2) is a metal foil with the apertures (3,4) formed in there.

14. A waveguide filter according to claim 9, wherein the conducting structure (2) is composed of a dielectric substrate that is metallized on one side, and the apertures (3,4) are formed in the metal layer of the substrate.

15. A waveguide filter according to claim 9, wherein the waveguide (1) has a rectangular cross section.

16. A waveguide filter according to claim 9, wherein the waveguide (1) has a circular cross section.

* * * * *